US010702904B2

(12) United States Patent
Marx

(10) Patent No.: US 10,702,904 B2
(45) Date of Patent: Jul. 7, 2020

(54) DECK LEVERAGE ANCHOR WITH SPACED-APART BODY PORTIONS

(71) Applicant: Michael J. Marx, Highland, MI (US)

(72) Inventor: Michael J. Marx, Highland, MI (US)

( * ) Notice: Subject to any disclaimer, the term of this patent is extended or adjusted under 35 U.S.C. 154(b) by 403 days.

(21) Appl. No.: 14/886,385

(22) Filed: Oct. 19, 2015

(65) Prior Publication Data

US 2016/0038985 A1 Feb. 11, 2016

Related U.S. Application Data

(63) Continuation of application No. 13/252,614, filed on Oct. 4, 2011, now Pat. No. 9,162,271.

(60) Provisional application No. 61/391,148, filed on Oct. 8, 2010.

(51) Int. Cl.
*B21D 1/14* (2006.01)
*B21D 1/12* (2006.01)

(52) U.S. Cl.
CPC ..... *B21D 1/14* (2013.01); *B21D 1/12* (2013.01); *B21D 1/145* (2013.01)

(58) Field of Classification Search
CPC .. B21D 1/12; B21D 1/145; B21D 1/14; E04G 21/3261
USPC ..... 72/457, 705; 411/430, 344; 182/3; 410/104; 269/203, 216, 35, 37
See application file for complete search history.

(56) References Cited

U.S. PATENT DOCUMENTS 3,381,925 A * 5/1968 Higuchi ..... B60P 7/0807 410/116
3,894,493 A * 7/1975 Strecker ..... B65D 90/0013 24/287
4,138,877 A * 2/1979 Specktor ..... B21D 1/145 410/80
4,262,519 A * 4/1981 Mason ..... B21D 1/14 72/457
4,297,963 A * 11/1981 Beacom ..... E02B 3/24 114/218
4,344,314 A * 8/1982 Aldrich ..... B21D 1/14 72/461
4,400,969 A * 8/1983 Specktor ..... B21D 1/145 269/203
4,519,236 A * 5/1985 Celette ..... B21D 1/14 72/457
4,545,697 A * 10/1985 Verdenne ..... F16B 37/042 403/230
4,930,333 A * 6/1990 Marbury ..... B21D 1/12 72/447
5,415,023 A * 5/1995 Hinson ..... B21D 1/145 72/457
6,367,305 B2 * 4/2002 Dobbins ..... B21D 1/12 72/446

(Continued)

*Primary Examiner* — Orlando E Aviles
*Assistant Examiner* — Seahee Yoon
(74) *Attorney, Agent, or Firm* — Harness, Dickey & Pierce, P.L.C.

(57) ABSTRACT

A deck anchor assembly for anchoring a frame loading member to a frame deck according to the principles of the present disclosure includes a deck leverage anchor and a coupler. The deck leverage anchor is configured to engage the frame deck, the deck leverage anchor including a locking mechanism configured to lock the deck leverage anchor relative to the frame deck. The coupler is configured to couple the frame loading member to the deck leverage anchor and is independently movable relative to the locking mechanism.

18 Claims, 10 Drawing Sheets

(56) References Cited

U.S. PATENT DOCUMENTS

| | | | | |
|---|---|---|---|---|
| 6,585,465 | B1 * | 7/2003 | Hammond | B60P 7/0815 410/104 |
| 6,616,388 | B1 * | 9/2003 | Floe | B60P 3/079 410/104 |
| 6,745,612 | B1 * | 6/2004 | McIlwraith | B21D 1/145 72/298 |
| 6,834,526 | B2 * | 12/2004 | Marx | F15B 11/006 72/453.18 |
| 7,343,771 | B2 * | 3/2008 | Marx | B21D 1/12 72/457 |
| 8,453,794 | B2 * | 6/2013 | Melic | E04G 21/3276 182/230 |
| 9,162,271 | B2 * | 10/2015 | Marx | B21D 1/12 |
| 2001/0032492 | A1 * | 10/2001 | Dobbins | B21D 1/12 72/705 |
| 2004/0099039 | A1 * | 5/2004 | Marx | B21D 1/12 72/457 |
| 2004/0103711 | A1 * | 6/2004 | McIlwraith | B21D 1/145 72/293 |
| 2004/0261330 | A1 * | 12/2004 | Oliver | E02D 5/801 52/155 |
| 2014/0102040 | A1 * | 4/2014 | Crook | F16B 13/0808 52/745.21 |

* cited by examiner

DECK LEVERAGE ANCHOR WITH SPACED-APART BODY PORTIONS

CROSS-REFERENCE TO RELATED APPLICATIONS

This application is a continuation of U.S. patent application Ser. No. 13/252,614 filed on Oct. 4, 2011 (issued as U.S. Pat. No. 9,162,271) which claims the benefit of U.S. Provisional Application No. 61/391,148, filed on Oct. 8, 2010. The entire disclosures of each of the above applications are incorporated herein by reference.

FIELD

The present disclosure relates generally to frame racks, and more specifically, to an apparatus to couple a hydraulic ram to a frame deck.

BACKGROUND

This section provides background information related to the present disclosure which is not necessarily prior art.

Frame racks are typically used to straighten the frame of an automotive vehicle after a collision. A frame rack has a deck onto which the vehicle is placed. A number of towers are positioned around the frame rack. The towers have a chain connected thereto that is coupled to a ram. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

To place tension on the vehicle in a slightly different direction, a separate hydraulic ram is sometimes coupled to a frame deck. The hydraulic ram may provide push/pull capabilities. Because a tower may not be available, a portable hydraulic ram may be used. The portable hydraulic ram is typically coupled to the frame deck using hooks. One problem with using a hook is that the frame deck is typically formed of a sheet of steel material, commonly 0.5" thick. Although the thickness is substantial, the frame deck may easily be bent when localized pulling on the order of thousands or even tens of thousands of pounds takes place during a straightening operation. If the frame rack is damaged, expensive repairs may be required to be performed. This may result in lost time and thus revenue for the frame rack operator.

It would therefore be desirable to provide a system for allowing flexibility in the frame straightening process and reduce potential damage to frame racks. Also, it is desirable to allow pulling at various angles with respect to the deck.

SUMMARY

This section provides a general summary of the disclosure, and is not a comprehensive disclosure of its full scope or all of its features.

The present disclosure provides a system suitable for use with a hydraulic actuator that can be easily maneuvered and positioned on a deck such as a deck of a frame rack.

A deck anchor assembly for anchoring a frame loading member to a frame deck according to the principles of the present disclosure may include a deck leverage anchor and a coupler. The deck leverage anchor is configured to engage the frame deck, the deck leverage anchor including a locking mechanism configured to lock the deck leverage anchor relative to the frame deck. The coupler is configured to couple the frame loading member to the deck leverage anchor and is independently movable relative to the locking mechanism.

A deck anchor assembly for anchoring a frame loading member to a frame deck according to the principles of the present disclosure may include a first plate, a base, a second plate, a locking mechanism, and a coupler. The first plate is configured to engage a first surface of the frame deck when the deck anchor assembly is disposed within an opening in the frame deck. The base is attached to the first plate and configured to engage the opening in the frame deck when the first plate engages the first surface of the frame deck. The second plate is coupled to and spaced apart from the first plate. The second plate is configured to engage a second surface of the frame deck that is opposite from the first surface when the first plate engages the first surface of the frame deck.

The locking mechanism is configured to lock the deck anchor assembly relative to the frame deck when the deck anchor assembly is disposed within the opening in the frame deck. The coupler is configured to couple the frame loading member to the first plate. The coupler is independently movable relative to the locking mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
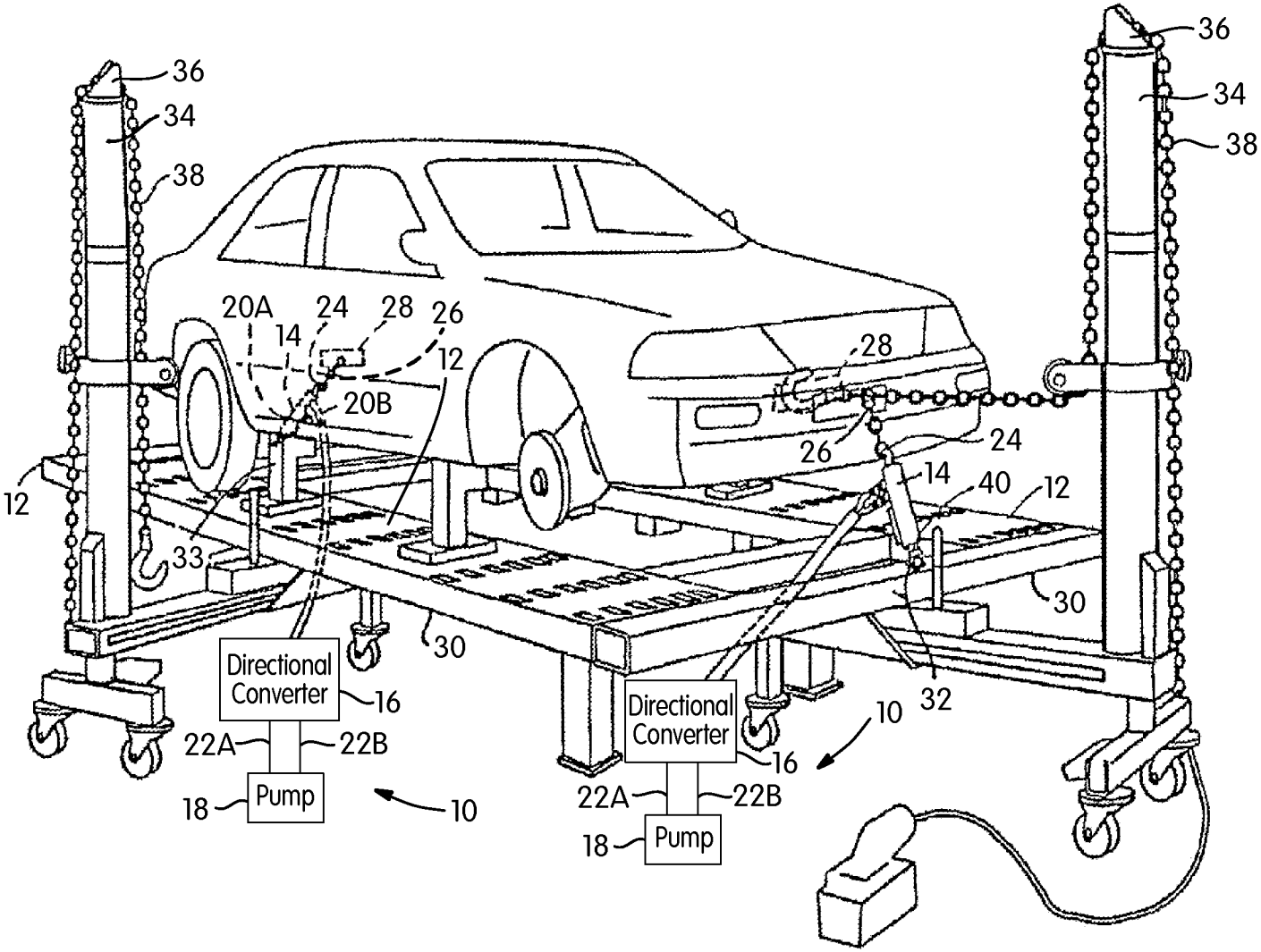
FIG. 1 is an isometric view of a vehicle mounted on a frame deck and hydraulic systems coupled to the vehicle and anchored to the frame deck using a deck leverage anchor according to the present disclosure.

Example embodiments will now be described more fully with reference to the accompanying drawings.

In the following figures, the same reference numerals will be used to identify the same components. The following description is set forth with respect to a frame rack for an automotive vehicle. However, the present application has several uses for mounting a device to a deck. The drawings are to scale, and the geometric relationships (e.g., angles, proportions) between elements shown in the drawings are in accordance with the principles in the present disclosure. However, the drawings are provided for illustrative purposes only and should not be limiting unless set forth in the claims of the present disclosure. Further, the embodiments set forth herein illustrate various alternative features. The various features, however, may be interchanged in the different embodiments. Further, although a two surface deck is used in the following examples, in its simplest form the deck may be a single planar surface.

Referring now to FIG. 1, two hydraulic frame straightening systems 10 according to the present disclosure are illustrated. Hydraulic systems 10 are illustrated used on a frame rack 12. As mentioned above, however, the frame rack 12 is merely illustrative of one of the many applications of the present disclosure. Hydraulic system 10 includes a hydraulic actuator 14, a directional converter 16, and a pump 18. A suitable directional converter is described in U.S. Pat. No. 6,834,526, filed on Jun. 5, 2002, the disclosure of which is incorporated by reference herein.

As illustrated, two hoses 20A and 20B, fluidly couple directional converter 16 and hydraulic actuator 14. Also, two hoses 22A and 22B fluidly couple directional converter 16 and pump 18. Hydraulic actuator 14 may have a mechanical coupling device such as a pair of claw hooks 24. It should be noted that in various applications claw hooks 24 may be substituted with other mechanical fastening devices such as bolt down components, loops, stays, or a deck leverage anchor 40 according to the present disclosure. Claw hook 24 is illustrated mechanically coupled to a chain 26, which in turn is coupled to a portion of a frame 28 of an automotive vehicle.

Frame rack 12 may also include various towers 34 that include a guide 36 and a chain 38. Of course, different numbers of towers 34 may be used on a frame rack. A support 33 may be used to support the vehicle. Frame rack 12 has a deck 30 for positioning a vehicle thereon. Deck 30 may have openings 32 or tie down holes positioned therethrough. Deck leverage anchor 40 may be secured at least partially within one of the openings 32.

Figure 2:
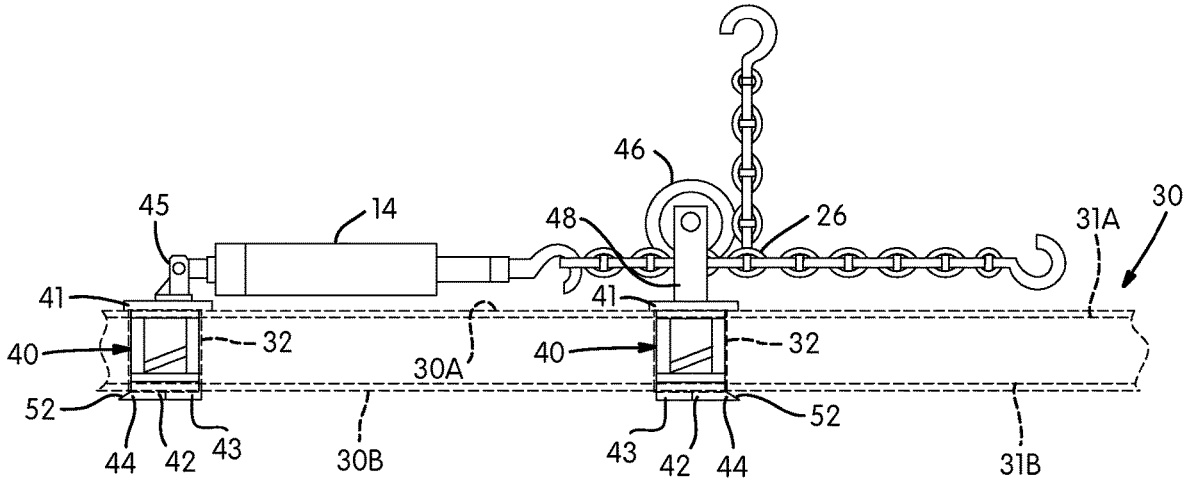
FIG. 2 is a side view of a hydraulic system anchored to a frame deck using a deck leverage anchor according to the present disclosure.

Referring now to FIG. 2, hydraulic actuator 14 is illustrated coupled to deck 30. Deck 30 is shown in phantom to illustrate components that may otherwise be hidden. Deck 30 may have a first surface 30A spaced apart from and/or parallel to a second surface 30B. The first surface 30A may be disposed on an upper plate 31A of deck 30, and the second surface 3AB may be disposed on a lower plate 31B of deck 30. The upper plate 31A and the lower plate 31B may be spaced apart from and/or parallel to each other.

Deck leverage anchor 40 includes an upper plate 41, a lower plate 42, and a swivel plate 43 that swivels with respect to the lower plate 42. The upper plate 41 and the lower plate 42 may be vertically spaced apart and connected to each other using spacers or risers, as discussed below.

Deck leverage anchor 40 may be inserted into the opening 32 such that the upper plate 41 engages or rests on the first surface 30A and a flange 44 on the lower plate 42 engages the second surface 30B. The upper plate 41 and the lower plate 42 of deck leverage anchor 40 may be parallel to the upper plate 31A and the lower plate 32A of deck 30. The profile of the lower plate 42 may be sized to fit within the opening 32 to allow insertion of deck leverage anchor 40 into the opening. As discussed below, the swivel plate 43 may then be rotated from an unlocked position to a lock position such that the swivel plate 43 engages the second surface 30B. In the lock position, opposite ends of deck leverage anchor 40 engage the second surface 30B. As a result, deck leverage anchor 40 is locked in place relative to deck 30. In this regard, the swivel plate 43 and components used to rotate and/or retain the swivel plate 43 may be collectively referred to as a locking mechanism. The components used to rotate the swivel plate 43 may include a lever disposed above deck 30 and components that couple the lever to the swivel plate 43 such that the locking mechanism is accessible in an area other than under deck 30.

Hydraulic actuator 14 is coupled to deck 30 using an actuator coupler 45. Actuator coupler 45 couples hydraulic actuator 14 to deck leverage anchor 40. As discussed in more detail below, actuator coupler 45 may be rotated with respect to deck leverage anchor 40 and independent from the swivel plate 43.

A pulley 46 may also be coupled to deck 30. Pulley 46 may be coupled to deck 30 using a pulley coupler 48. Pulley coupler 48 couples pulley 46 to deck leverage anchor 40. As discussed in more detail below, pulley coupler 48 may be rotated with respect to deck leverage anchor 40 and independent from the swivel plate 43. The hydraulic actuator 14 and the pulley 46 may be referred to as frame loading members, as the hydraulic actuator 14 and the pulley 46 are used to apply a load on a vehicle frame.

Figure 3:
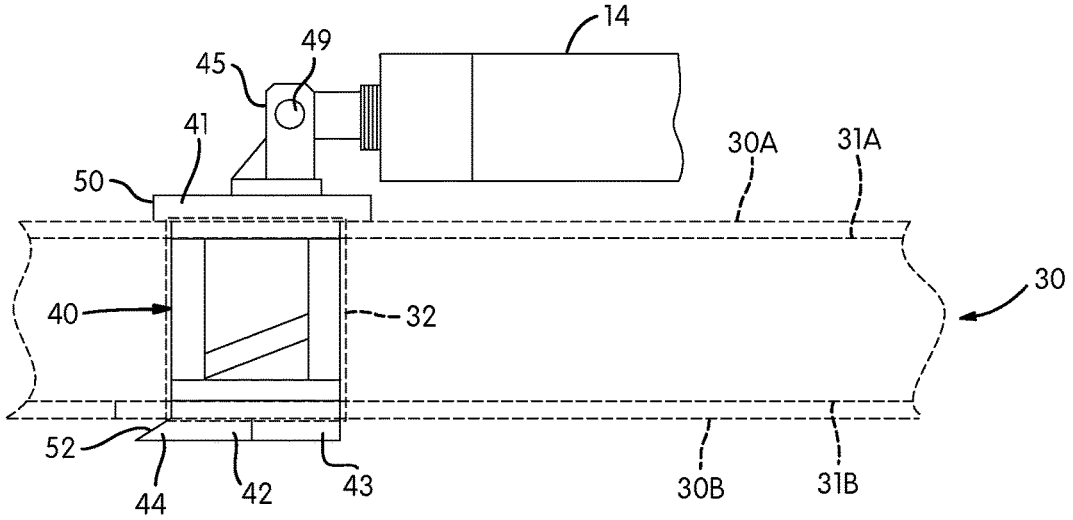
FIG. 3 is a side view of a hydraulic actuator anchored to a frame deck using a deck leverage anchor according to the present disclosure.

Referring now to FIG. 3, actuator coupler 45 and deck leverage anchor 40 are illustrated in further detail relative to deck 30. Deck 30 is shown in phantom to illustrate components that may otherwise be hidden. Actuator coupler 45 is coupled to hydraulic actuator 14 using a pin or fastener 49. The size of the upper plate 41 is such that the upper plate 41 remains above the first surface 30A while a portion of deck leverage anchor 40 extends below the first surface 30A. For example, the perimeter of the upper plate 41 may be larger than the perimeter of the opening 32. The upper plate 41 includes a flange 50 that engages the portion of the first surface 30A surrounding the opening 32.

The flange 44 of the lower plate 42 includes an upper surface 44A, a lower surface 44B, and a ramped surface 52. The ramped surface 52 of the flange 44 inhibits contact between the flange 44 and the deck 30 when the flange 44 is positioned below the second surface 30B. This facilitates insertion of deck leverage anchor 40 into the opening 32. To assist insertion the bottom of the deck anchor assembly 116 has an angled edge 52A that is disposed on the opposite side of the deck anchor assembly 116.

Figure 4:
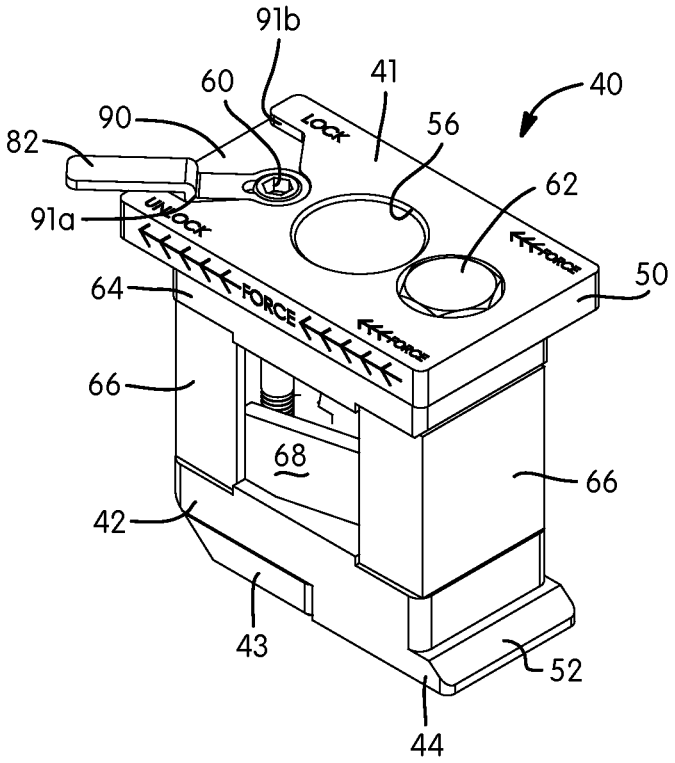
FIG. 4 is an isometric view of a deck leverage anchor according to the present disclosure, the deck leverage anchor including a locking mechanism in an unlocked position.
Figure 5:
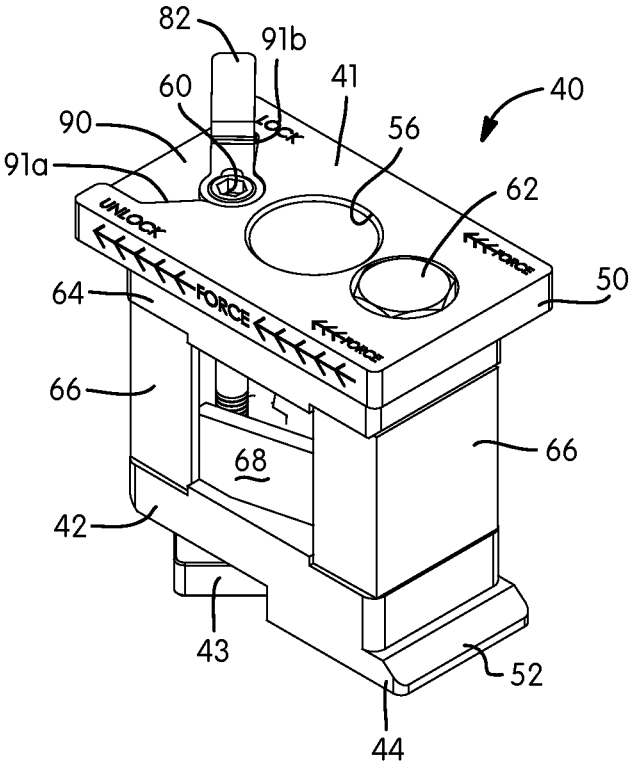
FIG. 5 is an isometric view of the deck leverage anchor of FIG. 4 with the locking mechanism in a locked position.
Figure 6:
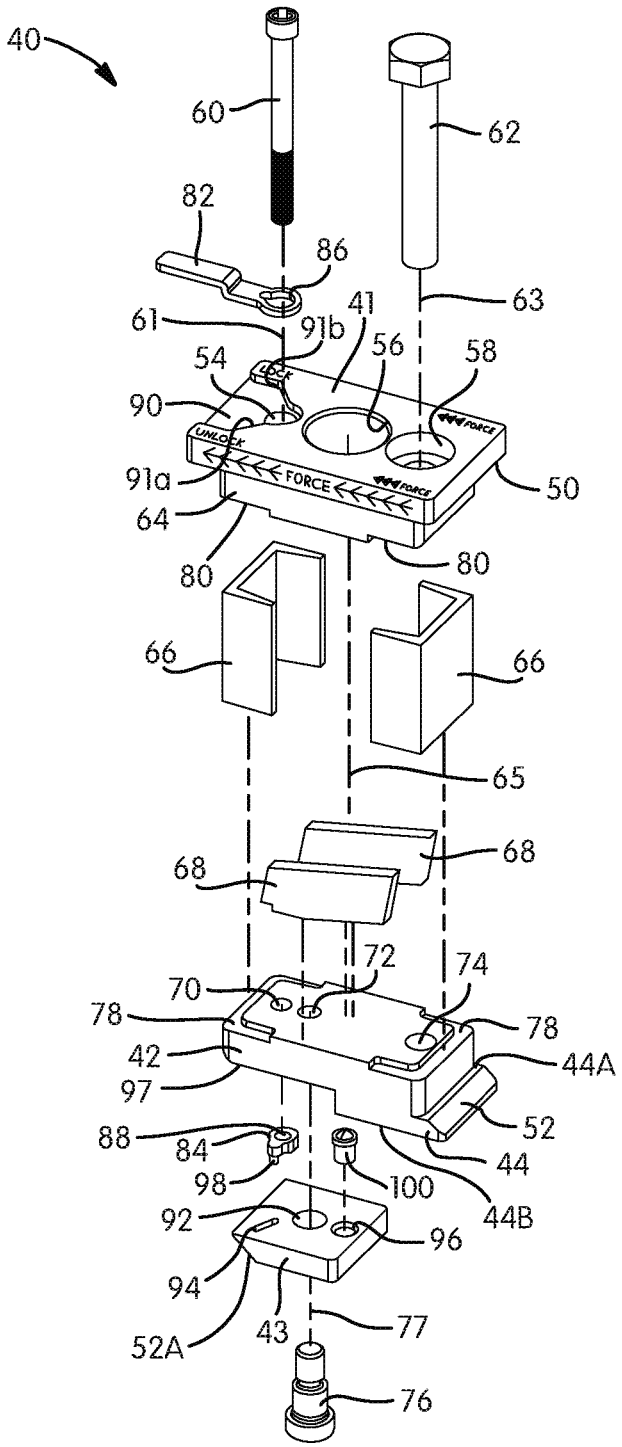
FIG. 6 is an exploded isometric view of the deck leverage anchor of FIG. 4.

Referring now to FIGS. 4 through 8, deck leverage anchor 40 is illustrated in greater detail. The upper plate 41 defines a first hole 54, a second hole 56, a third hole 58, as best shown in FIG. 6. The first hole 54 receives an extension pin or bolt 60. The center of the bolt 60 may be parallel to and/or aligned with an axis 61 that extends through the center of the first hole 54. The second hole 56 is configured to receive a coupler such as the actuator coupler 45 or the pulley coupler 48. The third hole 58 receives a mounting bolt 62. The center of the bolt 62 may be parallel to and/or aligned with an axis 63 that extends through the center of the third hole 58. The third hole 58 is counterbored to accommodate the head of the bolt 62 to prevent contact between the coupler and the head of the bolt 62 when the coupler is rotated about the second hole 56. The center of the coupler may be parallel to and/or aligned with an axis 65 that extends through the center of the second hole 56. The coupler may swivel on an axis (e.g., axis 65) that is parallel to and/or aligned with its insertion direction, as discussed below with reference to FIG. 15.

A base 64 may be formed (e.g., machined) integrally with the upper plate 41. Alternatively, the base 64 and the upper plate 41 may be formed separately and attached together. The flange 50 on the upper plate 41 is the portion of the upper plate 41 that extends beyond the perimeter of the base 64. The base 64 may be sized to fit within and engage the opening 32 in the deck 30.

Risers 66 couple and space apart the upper plate 41 and the lower plate 42. The risers 66 may be c-channels, as shown, and may be spaced apart and/or parallel to one another. In addition, the risers 66 may be parallel to the axis 63 and/or the insertion direction of the bolts 60 and/or the bolt 62. The heights of the risers 66 may be selected to ensure that the swivel plate 43 may be rotated into engagement with the second surface 30B when the upper plate 41 is resting on the first surface 30A, as discussed above. The longitudinal ends of the risers 66 are attached (e.g., welded) to the base 64 and the lower plate 42.

Cross members or gussets 68 extend between the risers 66. The gussets 68 may increase the stiffness and/or strength of deck leverage anchor 40. The gussets 68 may have a generally parallelogram shape. The longitudinal ends of the gussets 68 are attached (e.g., welded) to the risers 66.

The lower plate 42 defines a first hole 70, a second hole 72, and a third hole 74, as best shown in FIG. 6. The first hole 70 receives the bolt 60. The second hole 72 receives a fastener 76, such as a shield screw, that couples the swivel plate 43 to the lower plate 42. The center of the fastener 76 may be parallel to and/or aligned with an axis 77 that extends through the center of the first hole 70. The swivel plate 43 may rotate on the axis 77. The third hole 74 receives the bolt 62. The bolt 62 may be threaded into the third hole 74. The axes 61, 63, 65, and/or 77 may be parallel to and/or offset from one another.

The lower plate 42 also defines recessed surfaces 78 and the base 64 defines recessed surfaces 80, as best shown in FIG. 6. The recessed surfaces 78, 80 may be configured to receive the longitudinal ends of the risers 66. This facilitates attaching the risers 66 to the base 64 and the lower plate 42.

The bolt 60 extends through the first hole 54 in the upper plate 41 and through the first hole 70 in the lower plate 42. The bolt 60 couples a lever 82 to a cam 84 and the cam 84 engages the swivel plate 43 such that the swivel plate 43 rotates with the lever 82 between the unlocked position and the locked position, as described in more detail below. The bolt 60 extends through a hole 86 in the lever 82. The lever 82 and the cam 84 are attached to the bolt 60. For example, the lever 82 may be welded to the bolt 60, and the bolt 60 may be threaded into a hole 88 in the cam 84. A portion of the lever 82 may be captured between the head of the bolt 60 and a recessed surface 90 in the upper plate 41. At least a portion of the lever 82 may rotate within a plane that is parallel to the recessed surface 90 in the upper plate 41 and the surfaces 30A, 30B on deck 30. In addition, the lever 82 may rotate within a plane that is perpendicular to the axis 61, the axis 63, the axis 65, the risers 66 and/or the axis 77.

The lower plate 42 further defines a first surface 91*a* and a second surface 91*b*. The first surface 91*a* engages the lever 82 when the lever 82 is in the unlocked position, as best shown in FIG. 4. The second surface 91*b* engages the lever 82 when the lever 82 is in the locked position, as best shown in FIG. 5.

The bolt 62 extends through the third hole 58 in the upper plate 41 and extends at least partially through the third hole 74 in the lower plate 42. The bolt 62 couples the upper plate 41 and the lower plate 42. The bolt 62 may be used to couple the upper plate 41 and the lower plate 42 before the risers 66 are attached to the base 64 and the lower plate 42. In addition, the bolt 62 may be used to increase the strength of the connection between the upper plate 41 and the lower plate 42.

The swivel plate 43 defines a first hole 92, a channel 94, and a second hole 96, as best shown in FIG. 6. The fastener 76 may extend through the first hole 92 in the swivel plate 43 and thread into the second hole 72 in the lower plate 42. Thus, the swivel plate 43 may be captured between the head of the fastener 76 and a recessed surface 97 in the lower plate 42. The channel 94 receives a pin 98 on the cam 84. The second hole 96 receives a ball plunger 100. The ball plunger 100 is configured to lock the swivel plate 43 relative to the lower plate 42. The ball plunger 100 may be press fit into the second hole 96.

Figure 7:
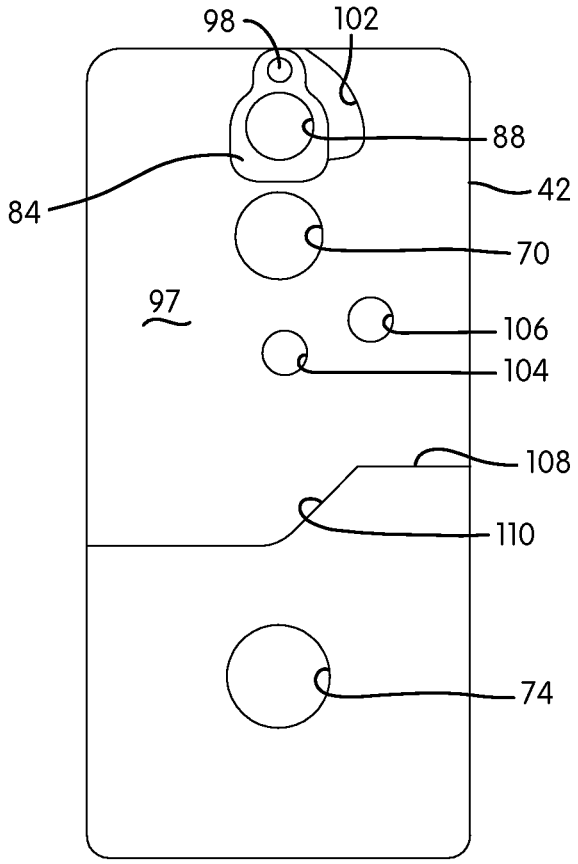
FIG. 7 is a bottom view of the deck leverage anchor of FIG. 4 with a portion of the locking mechanism removed.

The lower plate 42 further defines a groove 102, an unlock detent 104, a lock detent 106, a first surface 108, and a second surface 110, as best shown in FIG. 7. The groove 102 accommodates the cam 84 as the cam 84 rotates. The unlock detent 104 receives the ball plunger 100 and the first surface 108 engages the swivel plate 43 when the swivel plate 43 is in the unlocked position. The lock detent 106 receives the ball plunger 100 and the second surface 110 engages the swivel plate 43 when the swivel plate 43 is in the locked position.

Figure 8:
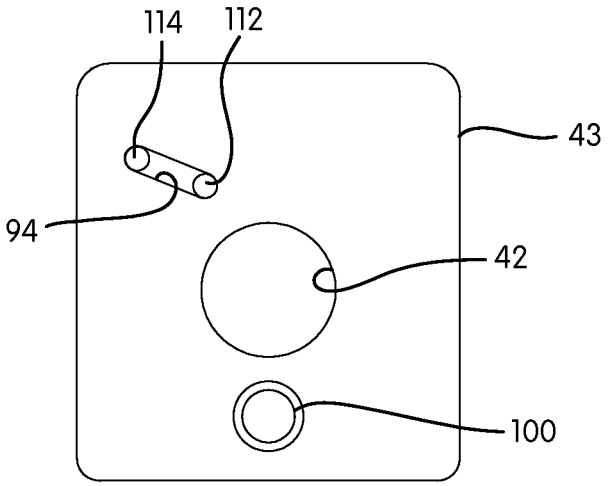
FIG. 8 is a top view of the portion of the locking mechanism removed from FIG. 7.

The channel 94 in the swivel plate 43 may define an unlock detent 112 and a lock detent 114, as best shown in FIG. 8. The unlock detent 112 receives the pin 98 on the cam 84 when the swivel plate 43 is in the unlocked position. The lock detent 114 receives the pin 98 on the cam 84 when the swivel plate 43 is in the locked position.

Figure 9:
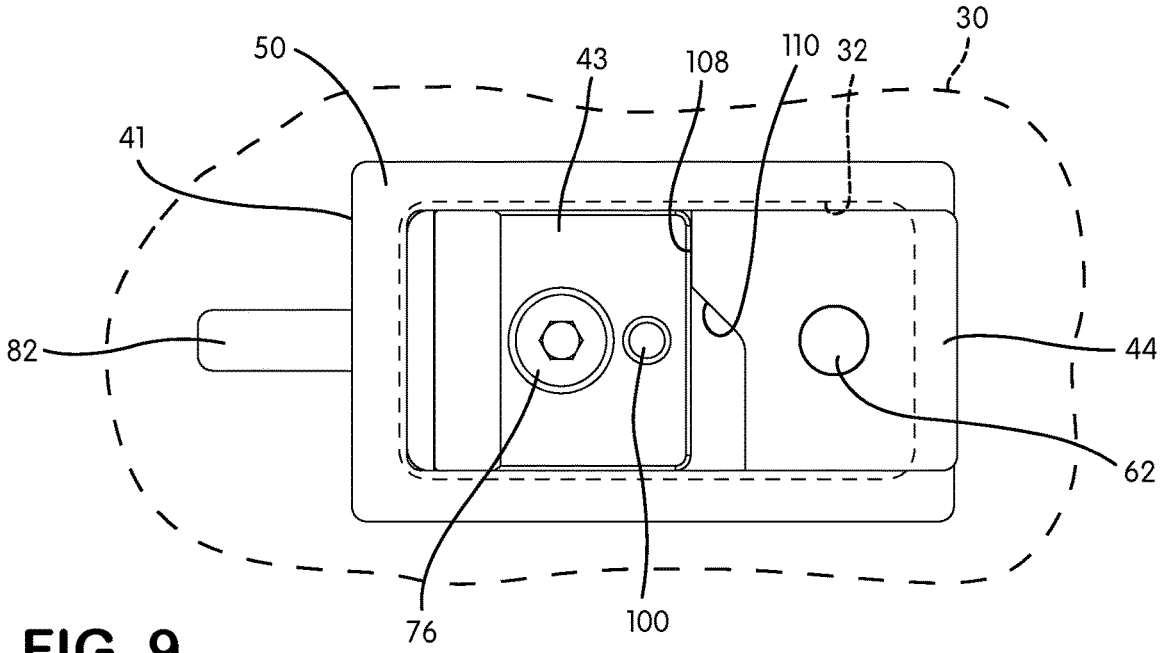
FIG. 9 is a bottom view of the deck leverage anchor of FIG. 4 disposed in an opening in a frame deck, with the locking mechanism in the unlocked position.

With continued reference to FIGS. 4 through 8, and additional reference to FIGS. 9 through 12, operation of deck leverage anchor 40 will now be described in detail. Deck leverage anchor 40 may be inserted into the opening 32 within deck 30 when the lever 82 is in the unlocked position. When the lever 82 is in the unlocked position, the profile of the swivel plate 43 is aligned with the profile of the lower plate 42, as best shown in FIG. 9. Thus, deck leverage anchor 40 may be inserted into the opening 32 in deck 30 without interference between the swivel plate 43 and deck 30.

Figure 11:
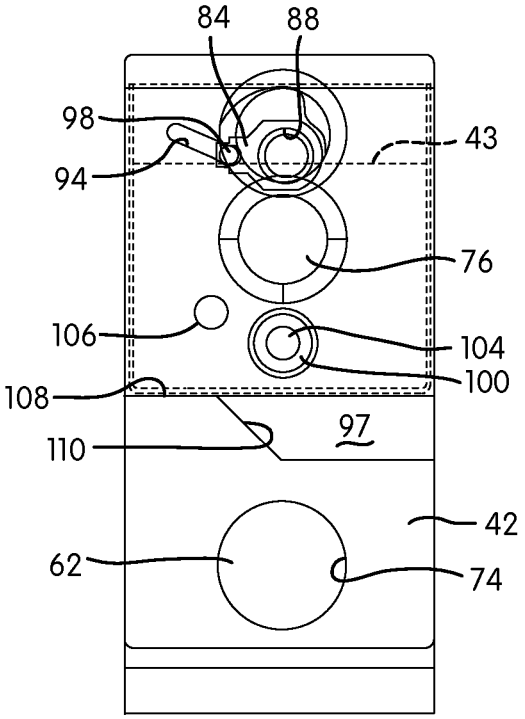
FIG. 11 is a bottom view of the deck leverage anchor of FIG. 4 with the locking mechanism in the unlocked position and a portion of the locking mechanism shown in phantom.

In addition, in the unlocked position, the ball plunger 100 engages the unlock detent 104 in the lower plate 42, as best shown in FIG. 11. Since the ball plunger 100 is inserted through the hole 96 in the swivel plate 43, the engagement between the ball plunger 100 and the unlock detent 104 retains the swivel plate 43 in the unlocked position. Further, in the unlocked position, the unlock detent 112 in the channel 94 of the swivel plate 43 (shown in FIG. 8) engages the pin 98 on the cam 84. Since the cam 84 is coupled to the lever 84 via the bolt 60, the engagement between the unlock detent 112 and the pin 98 retains the lever 84 in the unlocked position.

Deck leverage anchor 40 is inserted into the opening 32 in deck 30 as discussed above with reference to FIG. 2. The lever 82 may then be rotated from the unlocked position to the locked position. In turn, the lever 82 rotates the bolt 60, the bolt 60 rotates the cam 84, and the pin 98 on the cam 84 engages and moves along the channel 94 in the swivel plate 43. This causes the swivel plate 43 to rotate and disengages the ball plunger 100 from the unlock detent 104 in the lower plate 42. The lever 82 rotates about the center of the bolt 60 and the swivel plate 43 rotates about the center of the fastener 76. Thus, the rotational axes of the swivel plate 43 and the lever 82 are offset from each other.

Figure 10:
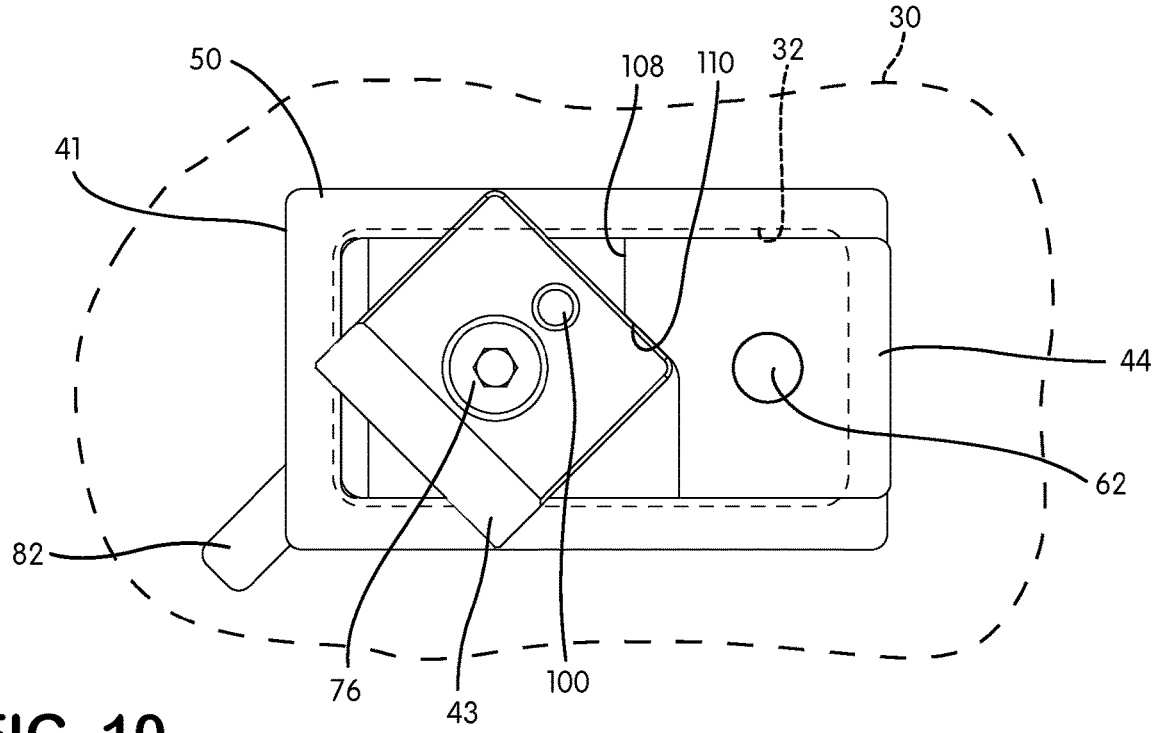
FIG. 10 is a bottom view of the deck leverage anchor of FIG. 4 disposed within an opening in a frame deck, with the locking mechanism in the locked position.

In the locked position, the perimeter of the swivel plate 43 extends beyond the perimeter of the opening 32 in deck 30, as best shown in FIG. 10. Thus, the flange 44 on the lower plate 42 and the swivel plate 43 engage portions of deck 30 adjacent to opposite ends of the opening 32. This engagement prevents removal of deck leverage anchor 40 from the opening 32.

Figure 12:
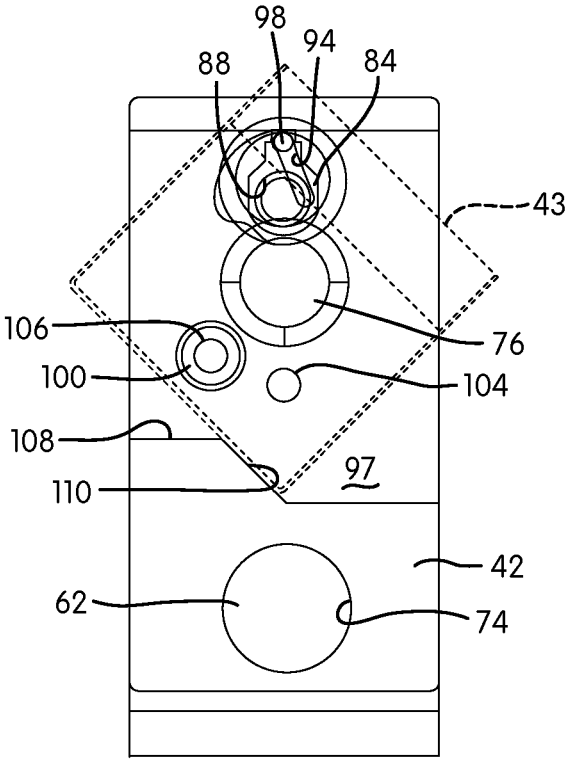
FIG. 12 is a bottom view of the deck leverage anchor of FIG. 4 with the locking mechanism in the locked position and a portion of the locking mechanism shown in phantom.

In addition, in the locked position, the ball plunger 100 engages the lock detent 106 in the lower plate 42, as best shown in FIG. 12. Since the ball plunger 100 is inserted through the hole 96 in the swivel plate 43, the engagement between the ball plunger 100 and the lock detent 106 retains the swivel plate 43 in the locked position. Further, in the locked position, the lock detent 114 in the channel 94 of the swivel plate 43 (shown in FIG. 8) engages the pin 98 on the cam 84. Since the cam 84 is coupled to the lever 82 via the bolt 60, the engagement between the lock detent 114 and the pin 98 retains the lever 82 in the locked position.

To remove deck leverage anchor 40 from the opening 32 in deck 30, the lever 82 may be rotated from the locked position to the unlocked position. The first surface 91*a* of the upper plate 41 may act as a stop for the lever 82 and the first surface 108 may act as a stop for the swivel plate 43 as the lever 82 is rotated to the unlocked position. The second surface 91*b* of the upper plate 41 may act as a stop for the lever 82 and the second surface 110 may act as a stop for the swivel plate 43 as the lever 82 is rotated to the locked position.

Figure 13:
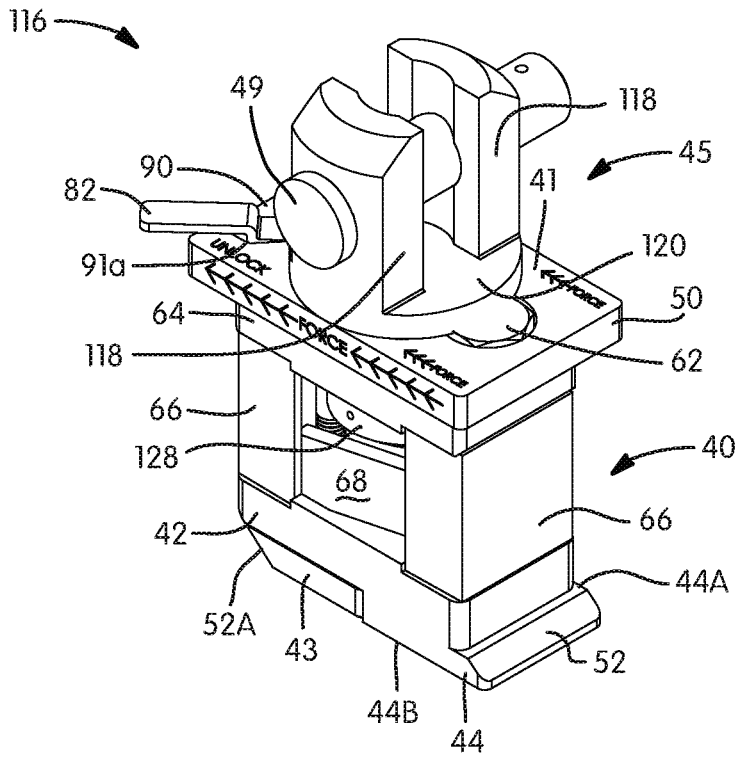
FIG. 13 is an isometric view of a deck anchor assembly including the deck leverage anchor of FIG. 4 and an actuator coupler, with the locking mechanism in the unlocked position.
Figure 14:
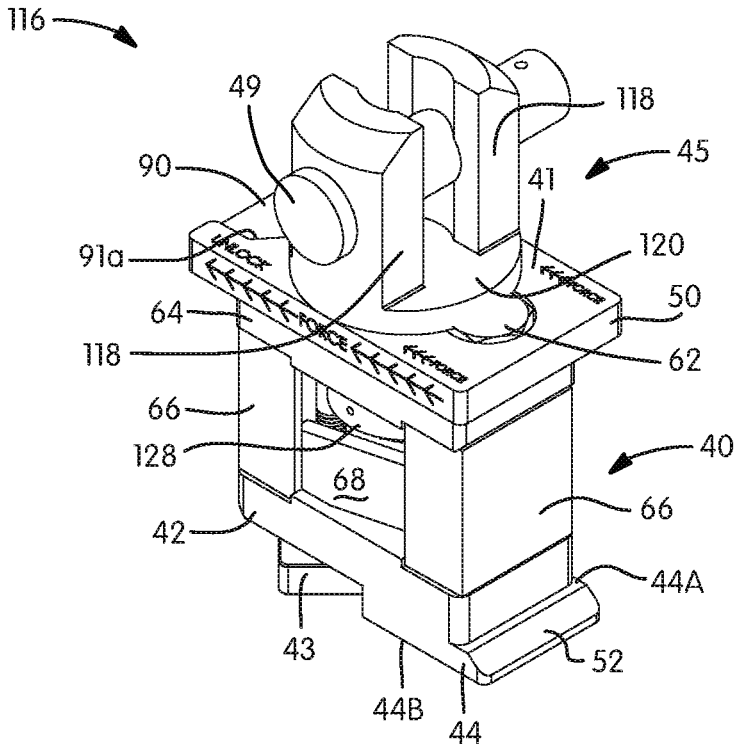
FIG. 14 is an isometric view of the deck anchor assembly of FIG. 13 with the locking mechanism in the locked position.
Figure 15:
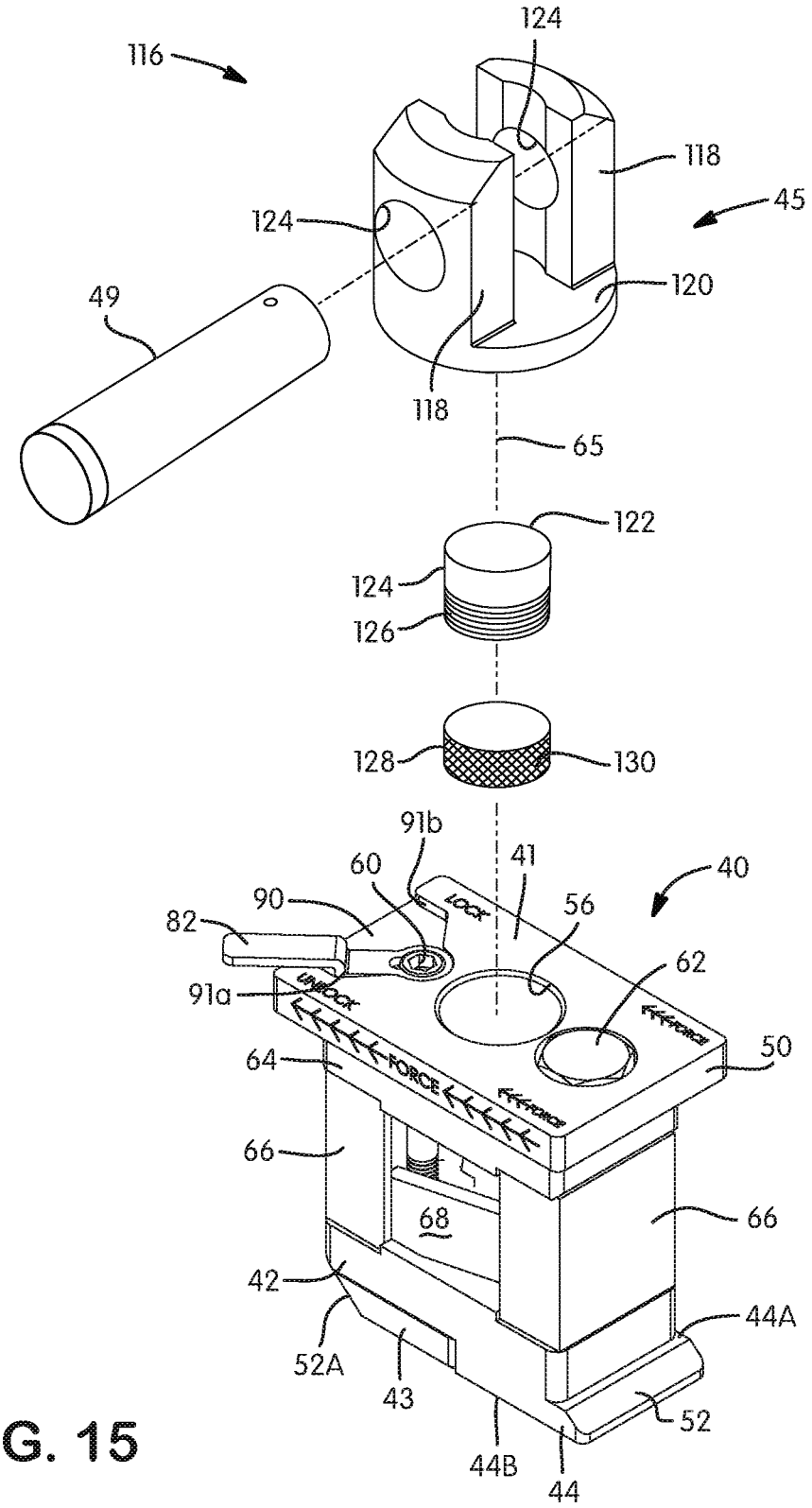
FIG. 15 is an isometric view of the deck anchor assembly of FIG. 4 and an exploded isometric view of the actuator coupler of FIG. 13.

Referring now to FIGS. 13 through 15, a deck anchor assembly 116 that includes deck leverage anchor 40 and the actuator coupler 45 is illustrated. The actuator coupler 45 includes extensions 118 extending from one side of a base 120 and a shaft 122 extending from the opposite side of the base 120, as best shown in FIG. 15. The extensions 118, the base 120, and/or the shaft 122 may be integrally formed. Alternatively, the extensions 118, the base 120, and/or the shaft 122 may be formed separately and attached to one another. The center of the base 120 and the center of the shaft 122 may be parallel to and/or aligned with the axis 65 that extends through the center of the second hole 56. In addition, the actuator coupler 45 may rotate about the axis 65.

The extensions 118 define holes 124 configured to receive the fastener 49, as best shown in FIG. 15. The extensions 118 are spaced apart such that the hydraulic actuator 49 may be inserted between the extensions 118. The fastener 49 may then be inserted through the holes 120 in the extensions 118 and through the hydraulic actuator 49 to secure the hydraulic actuator 49 to the actuator coupler 45. The base 120 may engage the top surface of the upper plate 41 as the actuator coupler 45 is rotated relative to deck leverage anchor 40. The bolts 60, 62 and the lever 82 may be recessed to avoid contact with the base 120 as the actuator coupler 45 is rotated relative to deck leverage anchor 40.

The shaft 122 extends through the second hole 56 in the upper plate 41 and the actuator coupler 45 freely rotates about the shaft 122 without restriction. The shaft 122 may include a bearing portion 124 and a threaded portion 126, as best shown in FIG. 15. The bearing portion 124 may engage the upper plate 41 as the actuator coupler 45 is rotated relative to deck leverage anchor 40. The threaded portion 126 may extend beyond the upper plate 41, and a collar 128 having inner threads 130 may be threaded onto the threaded portion 126 to secure the actuator coupler 45 to deck leverage anchor 40.

With continue reference to FIGS. 13 through 15, operation of the deck anchor assembly 116 will now be described. Deck leverage anchor 40 may be inserted into the opening 32 in deck 30 in the manner described above. In turn, the lever 82 may then be rotated from the unlocked position (FIG. 13) to the locked position (FIG. 14) to rotate the swivel plate 43 and thereby lock deck leverage anchor 40 in place relative to deck 30.

Notably, rotating the swivel plate 43 does not rotate the actuator coupler 45, as the actuator coupler 45 and the swivel plate 43 rotate independently. Thus, the actuator coupler 45 may be repositioned (e.g., rotated) without unlocking deck leverage anchor 40 from deck 30. This saves time and thus increases revenue for the frame rack operator. In addition, the lever 82 rotates about the center of the bolt 60, the swivel plate 43 rotates about the center of the fastener 76, and the actuator coupler 45 rotates about the center of the shaft 122. Thus, the rotational axes of the swivel plate 43, the actuator coupler 45, and the lever 82 are offset relative to one another.

Figure 16:
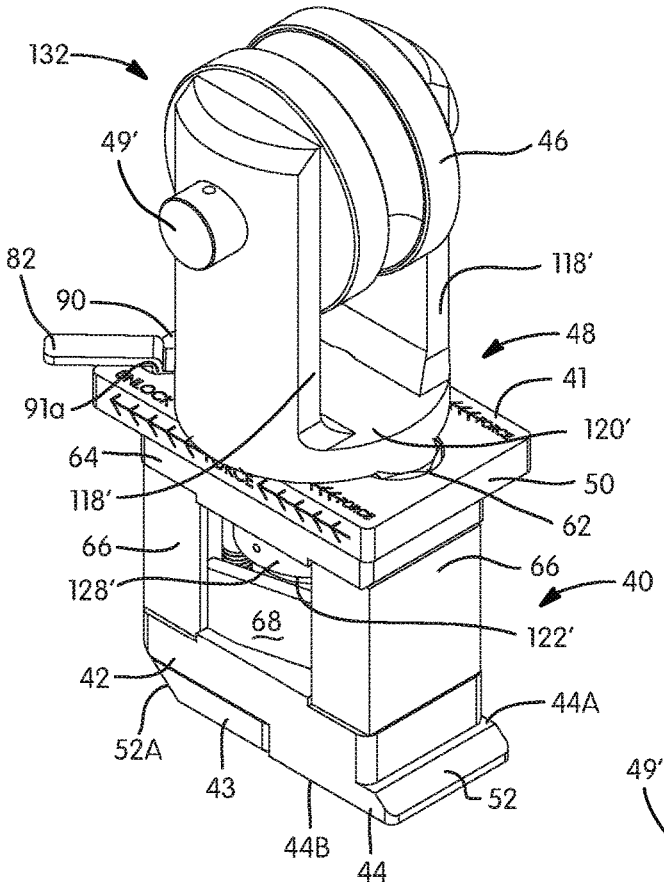
FIG. 16 is an isometric view of a deck anchor assembly including the deck leverage anchor of FIG. 4 and a pulley coupler, with the locking mechanism in the unlocked position.
Figure 17:
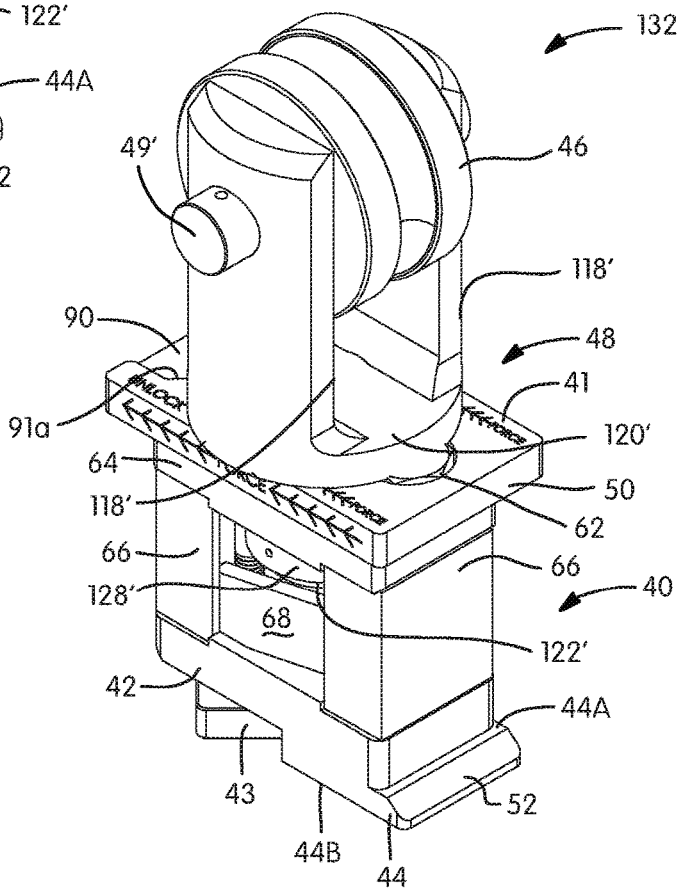
FIG. 17 is an isometric view of the deck anchor assembly of FIG. 16 with the locking mechanism in the locked position.

Referring now to FIGS. 16 and 17, a deck anchor assembly 132 that includes deck leverage anchor 40 and the pulley coupler 48 is illustrated. The structure of the deck anchor assembly 132 may be substantially similar to the structure of the deck anchor assembly 116 such that only differences between the two structures will now be described.

The pulley coupler 48 includes extensions 118'. The heights of the extensions 118' on the pulley coupler 48 may be greater than the heights of the extensions 118 on the actuator coupler 45 to accommodate the outer diameter of the pulley 46 and/or a chain engaging the pulley 46. In addition, the space between the extensions 118' on the pulley coupler 48 may be respectively greater than the heights of the extensions 118 and the space between the extensions 118 to accommodate the width of the pulley 46.

Operation of the deck anchor assembly 132 may be substantially similar to or identical to operation of the deck anchor assembly 116.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A deck anchor assembly for anchoring a frame loading member to a frame deck, said frame deck comprising a first side having a first opening and a second side having a second opening spaced apart from the first side, the deck anchor assembly comprising:

a first portion disposed directly adjacent to the first side;

a second portion comprising a flange extending therefrom, said flange configured to engage the second side of the frame deck, said flange comprising an upper surface and a lower surface, the upper surface and the lower surface being parallel to the second side, said upper surface being shorter than the lower surface, said flange further comprising a ramped surface connecting the upper surface and lower surface;

a riser portion fixedly coupled to and extending between the first portion and the second portion, the flange extends outward from and is positioned adjacent to and parallel with the second side, said riser portion sized to fit within the first opening and the second opening; and a coupler configured to couple the frame loading member to the first portion, wherein the coupler is independently movable relative to the first portion, the second portion and the riser portion;

said ramped surface tapers away from the second side of the frame deck, said flange and said ramped surface positioned below the second side of the frame deck to allow the flange and ramped surface to be inserted through the first opening and the second opening to allow the flange to be positioned directly adjacent to and engage the second side.

2. A system comprising:

the deck anchor assembly of claim 1; and further comprising the frame loading member being one of a hydraulic actuator and a pulley.

3. The deck anchor assembly of claim 1, wherein the ramped surface ramps thinner as a distance from the second portion increases.

4. The deck anchor assembly of claim 1, wherein the ramped surface inhibits contact between the flange and the frame deck when the flange is positioned below the second side.

5. The deck anchor assembly of claim 1, wherein the flange comprises a first flange surface parallel to the second side and the ramped surface.

6. The deck anchor assembly of claim 1, wherein the first portion is wider and longer than the first opening, wherein the second portion is narrower than and longer than the first opening and the second opening.

7. The deck anchor assembly of claim 1, wherein the coupler has a rotational axis positioned in about a center of the first portion.

8. The deck anchor assembly of claim 1, wherein the flange is configured to engage the second side of the frame deck adjacent to a lateral end of the second opening in the second side.

9. A deck anchor assembly for anchoring a frame loading member to a frame deck having an upper plate having a first surface with a first opening and a lower plate spaced apart from and parallel to the upper plate, said lower plate having a second surface and a second opening, the deck anchor assembly comprising:

a coupler configured to couple the frame loading member to the deck anchor assembly;

a first portion coupled to the coupler and configured to engage the first surface of the frame deck when the deck anchor assembly is disposed within the first opening and the second opening in the frame deck;

a base attached to the first portion and configured to engage the first opening in the frame deck when the first portion engages the first surface of the frame deck;

a riser sized to fit within the first opening and the second opening;

a second portion coupled to and spaced apart from the first portion by the riser, the second portion being configured to engage an edge of the lower plate when the first portion engages the first surface of the frame deck and a force in a direction away from a flange is placed on the coupler, said flange comprising an upper surface and a lower surface, the upper surface and the lower surface being parallel to the second surface, said upper surface being shorter than the lower surface, said flange further comprising a ramped surface connecting the upper surface and lower surface; and said flange extending from the second portion being configured to engage the second surface of the lower plate, said ramped surface tapering away from the second surface of the frame deck, said flange and said ramped surface positioned below the second surface of the frame deck to allow the flange and the ramped surface to be inserted through the first opening and the second opening to allow the flange to be positioned directly adjacent to and engage the second surface.

10. A system comprising:

the deck anchor assembly of claim 9; and further comprising the frame loading member being one of a hydraulic actuator and a pulley.

11. The deck anchor assembly of claim 9, wherein the flange comprises a ramped surface being integrally formed with the flange and the second portion.

12. The deck anchor assembly of claim 11, wherein the ramped surface is thinner as a distance from the second portion increases.

13. The deck anchor assembly of claim 11, wherein the ramped surface tapers away from the second surface when the deck anchor assembly is inserted into the first opening and the second opening.

14. The deck anchor assembly of claim 11, wherein the ramped surface inhibits contact between the flange and the frame deck when the flange is positioned below the second surface.

15. The deck anchor assembly of claim 9 wherein the flange comprises a first flange surface parallel to the second surface and the ramped surface.

16. The deck anchor assembly of claim 9, wherein the first portion is wider and longer than the first opening wherein the second portion is narrower than and longer than the first opening and the second opening.

17. The deck anchor assembly of claim 9, wherein the coupler has a rotational axis positioned in about a center of the first portion.

18. The deck anchor assembly of claim 9, wherein the flange is configured to engage the second surface of the frame deck adjacent to a lateral end of the second opening in the lower plate.

* * * * *